United States Patent [19]
Hofmann
[11] 4,382,554
[45] May 10, 1983

[54] FUEL INJECTION NOZZLE CONSTRUCTION

[75] Inventor: Karl Hofmann, Remseck, Fed. Rep. of Germany

[73] Assignee: Robert Bosch GmbH, Stuttgart, Fed. Rep. of Germany

[21] Appl. No.: 303,367

[22] Filed: Sep. 18, 1981

[30] Foreign Application Priority Data

Sep. 27, 1980 [DE] Fed. Rep. of Germany ..... 3036583

[51] Int. Cl.[3] ..... F02M 61/20
[52] U.S. Cl. ..... 239/533.9; 267/20 R
[58] Field of Search ..... 239/533.2–533.12; 267/20 R, 20 A, 20 C

[56] References Cited

U.S. PATENT DOCUMENTS

| | | | |
|---|---|---|---|
| 347,647 | 8/1886 | Scheen | 267/20 R |
| 1,690,893 | 11/1928 | Dorner | 239/533.9 X |
| 4,284,043 | 8/1981 | Happel | 239/533.2 X |
| 4,356,977 | 11/1982 | Hofmann | 239/533.9 |

FOREIGN PATENT DOCUMENTS

| | | | |
|---|---|---|---|
| 195179 | 1/1958 | Fed. Rep. of Germany | 239/533.5 |

*Primary Examiner*—John J. Love
*Assistant Examiner*—Paul A. Sobel
*Attorney, Agent, or Firm*—Frishauf, Holtz, Goodman & Woodward

[57] ABSTRACT

To provide two pressure ranges for selective control of the stroke of a fuel injection valve, the valve element has a plate-like rocker coupled thereto, which is engaged at one side by the customary closing spring, for example via a spring disk having a central projection fitting into a matching depression of the rocker element. The rocker element is pivotable about a pivot bearing (22), for example in form of a knife edge, secured to the needle valve, the pivot bearing engaging the side of the rocker element remote from the spring and subdividing the rocker element into two unequal rocker arms (24, 26) which, respectively, bear against shoulders (**25, 29*a*) of the housing. Upon application of fluid pressure in a first pressure level, the longer one of the rocker arms will be in engagement with a shoulder formed on the housing until sufficiently deflected to effect engagement of the shorter one of the rocker arms (26) with another shoulder (29*a*) of the housing to thereby change the leverage of force being transferred from the spring to the rocker arm and requiring substantially higher pressure of fluid in order to raise the needle valve beyond the engagement position of the shorter one (26) of the rocker arms with the second shoulder (29*a***) of the housing.

8 Claims, 3 Drawing Figures

FUEL INJECTION NOZZLE CONSTRUCTION

The present invention relates to a fuel injection nozzle, particularly to a fuel injection nozzle for internal combustion engines, typically Diesel engines.

BACKGROUND

Fuel injection nozzles for Diesel engines have to be capable of injecting fuel in substantially varying quantity, and under substantially varying pressure. Upon starting of a Diesel engine, and also during idling, or under low load conditions, a comparatively long period of time is available for carrying out the injection of fuel; as the speed increases, the fuel injection time decreases. Yet, at low speed and low load, only little fuel is needed. Various parameters of the injection fuel relationships and functions, such as cross section of the injection nozzle opening, stroke of the injection valve needle, closing force of the needle, and hence opening force, and injection pressure, are usually so arranged that the injection valve can supply the engine with required fuel at full-load operation and at maximum speed, thus obtaining maximum power output. Upon low-speed, low-power operation of the engine, and particularly upon starting, upon idling, and upon low load, only a small quantity of fuel, per unit time, will flow through a comparatively large cross-sectional opening of the nozzle. It has already been proposed to provide an injection valve which, as the needle stroke changes, provides fluid flow communication to sequentially positioned injection openings. To inject small quantities of fuel, the valve is controlled to have only a small stroke, so that, effectively, a smaller injection opening is commanded to be exposed than the injection opening available for larger quantities. It is quite possible, however, that the needle valve will open fully due to the initial pressure pulse, so that the entire and relatively small quantity of fuel is initially and immediately injected. The result is that the fuel is well atomized, considering the small quantity, but that the engine noise is considerable. Further, the needle valve may vibrate due to oscillations deriving from the counter spring or pressure waves which will occur in the supply line, resulting in noisy operation of the engine.

It has also been proposed to control movement of the needle valve upon starting, and otherwise upon low-speed operation of the engine, by providing a high-low control pressure stage which is so arranged that a force acts on the valve needle which increases as the opening stroke increases. Various solutions to so control the needle are known, for example the addition of a second closing spring, which becomes effective as the stroke of the needle increases. Constructing needle valves in accordance with such proposals increases the expense of construction and further the space required for building the injection valve.

The Invention

It is an object to control the forces acting on the needle of a fuel injection valve, typically for a Diesel engine, in a simple and reliable manner, which does not substantially increase the manufacturing costs, while effectively changing the operating characteristics of the valve in dependence on applied fuel pressure or quantity.

Briefly, a plate-like rocker element is provided which is retained to rock over a fulcrum point asymmetrical with respect to its longitudinal extent to subdivide the rocker element into two rocker lever arms of unequal length. The fulcrum point for the rocker lever may be formed, for example, by a knife edge positioned on the needle itself, and located, for example, off-center with respect to its longitudinal axis. The plate-like rocker element is engaged at the side remote from the fulcrum point by the customary closing spring for the valve.

The longer one of the rocker lever arms, formed by the asymmetrically positioned fulcrum point, bears against a shoulder in the housing at the side remote from the spring; the shorter one is positioned for engagement with a shoulder at the side of the spring.

When fuel pressure reaches the ring duct, provided as usual, near the injection end of the valve needle stem, the valve needle will rise, thus tending to pivot the rocker arm about the pivot point. In this, initial stroke, the needle valve will be acted on by the spring. As the needle continues to rise, the rocker plate will tip by engagement of the shorter one of the rocker arms with the closely adjacent shoulder in the housing, thus providing a force transfer lever from the spring to the needle valve over a short lever arm only, and, thus, in effect increasing the force acting on the needle valve over that which initially was required to lift the needle valve in equal distance. This maximum stroke of the needle valve is limited by engagement of the longer one of the rocker arms with another abutment formed in the valve at the side facing the spring.

The valve in accordance with the invention has the advantage that it can be readily made and is inexpensive; it is much cheaper than known solutions to obtain a dual-pressure lift-off stage arrangement. Practically all components of the valve can be standard and of exactly the same construction as mass-produced valves which do not have the dual pressure-displacement feature. The only difference will be the formation of a knife edge or pivot point for the rocker plate, and installation of the rocker plate as such. The shoulders can readily be formed within existing housings.

The valve has a further advantage over other injection valves with several springs: The relationship of the pressure ranges of the steps will always be the same, determined only by the respective lengths of the rocker arms, due to the offset of the pivot or fulcrum point. This length does not change with time and continued use, whereas a second spring used intermittently will have, in time, a different spring function and characteristic than when first installed and new.

The valve can be used with a dual needle arrangement, that is, a main needle and an auxiliary needle which is carried along by the main needle through a lost-motion arrangement when the main needle stroke exceeds the distance of the lost motion.

DRAWINGS

Figure 1:
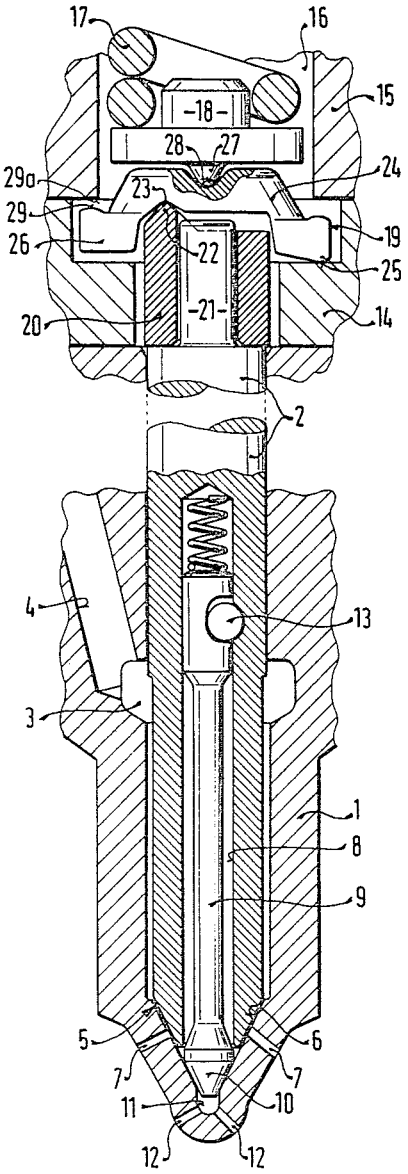
FIG. 1 is a highly schematic fragmentary longitudinal sectional view through a Diesel engine fuel injection valve with an auxiliary needle element, in which the closing spring acts on a rocker plate over a separate application plate.

The valves—of which only those parts necessary for an understanding of the invention are shown, the others being customary and standard—basically include a valve body 1 in which a valve needle 2 is axially slidably retained. The valve needle 2 defines, together with the valve body 1, a pressure chamber 3 which can have fuel supplied under pressure from a suitable pressure line 4. The valve needle 3 is radially sealed in the upper portion of valve body 1. It has a conical end 5 which, when closed as shown in FIG. 1, is seated on a matching valve seat 6 at the injection end portion of the valve, and separates the pressure chamber 3 from a first row of injection openings 7. The needle valve 2 is formed with a blind bore 8, open to the injection end, in which an auxiliary needle 9 is axially guided. The auxiliary needle 9 has a head 10 which, likewise, cooperates with a sealing seating surface 6, and which controls communication between the blind bore 8 and a small chamber 10 and injection openings 12.

Basic Injection Operation: Upon application of fuel under pressure through the inlet 4 to the chamber 3, the needle valve element 2 will be raised counter the force of a spring 17. Shifting of the needdle upwardly, under the influence of fuel pressure, permits passage of fuel from the chamber 3 to the injection opening 7 and, simultaneously, into the blind bore 8 within the needle 2. The auxiliary needle 9, at this initial excursion of the needle 2, closes the flow of fluid to the injection opening 12. As the pressure increases, or, respectively, if the quantity of fuel supplied to the chamber 3 rises, the valve needle element 2 will be shifted upwardly for a further extent, thus increasing its stroke. A bolt 13 then will engage the needle 9, so that the needle 9 will be raised off its seat and permit communication to the injection valve openings 12. The bolt 13 is located within the needle 2 and, as shown, is fitted into an opening laterally formed in the auxiliary needle 9. The opening is longer than the bolt to provide for lost motion. The difference between the length of the opening and the diameter of the bolt determines the initial stroke of the element 2 before the auxiliary needle 9 is carried along.

The assembly of the needle element 2 and the auxiliary needle 9 is held in position by a valve holder 15, secured to an intermediate bushing or plate 14. The valve holder 15 is extended upwardly, as well known, and retains the spring 17. The construction of the valve upwardly of that shown in FIG. 1 is standard and can be in accordance with any suitable and well known arrangement. The spring 17, at its lower end, acts on a spring disk 18 which operates as a pressure transfer device on the valve element 2.

In accordance with the present invention, the pressure transfer arrangement includes a rocker plate 19 and a support ring 20, fitted about a pin extension 21 of the needle element 2. The pin extension 21 of the needle element 2 is reduced in diameter over the thickness of the needle 2. The shoulder, thus formed, provides for transfer of the forces to the valve needle element 2, and hence transfer of forces from the spring 17 over the support ring 20 on the element 2.

The support ring 20, radially seen, has a knife edge extension 22 formed at the side facing the rocker plate 19. The rocker plate 19 is formed with a longitudinal groove or notch 23, fitted over the knife edge 22. The thus formed fulcrum point between the knife edge 22 and groove 23 subdivides the rocker plate 19 into two rocker plate lever arms of different lengths. The free end of the longer arm 24 is positioned on a shoulder 25 of the intermediate bushing or plate 14. The shorter lever arm 26 is located freely in the space between an upper shoulder 29*a* formed on the valve end portion 15, and the opposite side of the shoulder 25. Force of the closing spring 17 is transferred from the spring washer or plate 18 over a pressure bump or pressure point 27, which is retained in a depression 28 formed in the rocker plate 19. Transfer of force thus is coaxial with respect to the axis of the valve element 2, the spring disk or washer 18, and the spring, so that some distance will obtain between the engagement point of the projection 27 in the groove 28 of the rocker element 19 and the lateral position of the groove 23 which, with the knife edge 22, forms a fulcrum point to provide for force transformation.

Operation: Upon initiation of fuel injection, and for a first opening distance of the valve 2—and independent of the auxiliary element 9—the plate 19 will tip about the engagement surface 25. As the needle 2 rises, the free end of the shorter lever 26 will engage the shoulder 29*a* with its free end 29. The spring which, until that engagement, had been transferring pressure over the long lever arm from the knife edge 22 to engagement of the long arm 24 with the surface 25, will now act on the needle element 2 only over the short lever arm from the knife edge 22 to the engagement between surface 29 of the short lever arm and the valve abutment 29*a*. This provides a much shorter lever transmission and requires, therefore, a much higher force for equal distance. As soon as the pressure in the pressure chamber 3 has risen to the extent that the now much shorter leverage arrangement can be overcome, valve 2 is lifted further in opening direction for a further opening stroke. Upon still further lifting of valve 2, the longer lever arm 24 will lift off its engagement point with the shoulder 25 and will tip towards the valve holding element 15. When the longer lever arm 24 has reached the surface opposite surface 29*a* on the valve holding element 15, the needle element 2 has reached its maximum opening stroke.

The embodiment shown in FIG. 1 uses a dual-type needle, that is, a main needle element 2 and an auxilairy needle element 8. Other arrangements may, of course, be used. A straight, single, solid sliding needle or differently arranged valve elements are suitable. The present invention is not limited to valves in which the fuel injection depends on the excursion of the needles, but can be used, also, with fuel injection valves having a customary needle element which opens towards the interior so that, when the needle has reached its full stroke, a substantially larger quantity of fuel under higher pressure can be injected.

Figure 2:
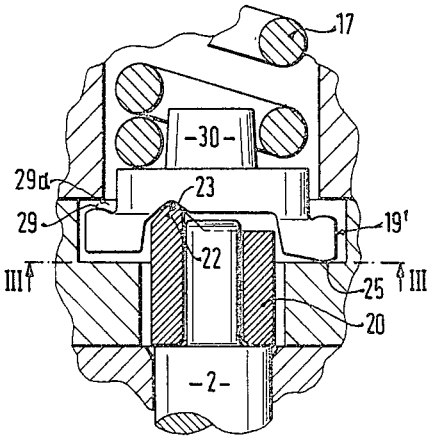
FIG. 2 is a fragmentary view of the spring application end illustrating another embodiment.

The spring washer or disk element 18, preferably, is shown with a central projection to provide for guidance of the lower portion of the spring 17. Different arrangements may be used. FIG. 2 illustrates an embodiment in which the same elements have been given the same reference numerals, and those which are only slightly changed, the same reference numerals with prime notations. In accordance with FIG. 2, and differing from FIG. 1, the spring 17 is engaged directly on the rocker plate 19′ which, on the side facing the spring 17, has a guide projection 30 formed thereon in order to guide the lower ends of the spring 17.

Figure 3:
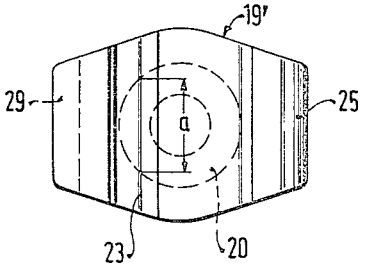
FIG. 3 is an end view taken along lines III—III of the rocker plate.

FIG. 3 illustrates the rocker plate 19′, looked at in the direction of the arrows III—III of FIG. 2. The groove 23 appears as a line. The outer diameter of the support ring 20 is shown in broken line, and permits a knife edge 22 having the longitudinal extent a. The engagement surface 25, which will be along a line, is visible; the engagement surface 29 which, also, will be in line form, is shown in broken line form since not visible from below.

Various changes and modifications may be made, and features described in connection with one embodiments may be used with the other. For example, the pressure transfer arrangement could be so made that the spring forces engage the rocker plate outside of the axis of the needle 2.

I claim:

1. Fuel injection valve for an internal combustion engine, especially a Diesel engine, having an elongated tubular housing (1) having nozzle openings (7, 12) at one end portion thereof;

a needle valve element (2, 8) longitudinally slidable in the housing and having a valve cone (5) adjacent the nozzle openings;

a closing spring (17) tending to press the needle valve element into closed position, the needle valve being lifted off closed position upon application of pressurized fuel applied through a fuel pressure line sufficient to lift off the valve cone, and comprising, in accordance with the invention, means limiting the stroke of the valve element (2) when the pressure in the fuel pressure line is of a first, or low engine power pressure level, lower than a second, or full-load pressure level, including A plate-like rocker element (19) engaged on one side by the closing spring (17);

a pivot bearing (22) secured to the needle valve and engaging the other side of the rocker element, asymmetrically, with respect to the end portions of the rocker element to subdivide the rocker element into two rocker lever arms (24, 26) of unequal lengths;

a first shoulder (25) formed in the housing and positioned for engagement by the end of the longer one (24) of the rocker arms, at the side remote from the spring;

a second shoulder (29*a*) formed on the housing and positioned for engagement by the end of the shorter one (26) of the rocker arms at the side facing the spring, initial movement of the needle valve element (2, 8) under the first pressure leaving the longer arm in engagement with the first shoulder of the housing, remote from the spring until, under increased pressure, the shorter arm (26) engages the second shoulder (29*a*) and, upon still increasing pressure, overcomes the lever arm force of the shorter lever arm to tip the shorter lever arm (24) about the pivot bearing (22) to permit further travel of the needle valve element.

2. Valve according to claim 1, wherein the valve element (2) is formed with a pin extension (21);

and a bearing ring (20) is fitted about the pin extension (21) in pressure transfer relation with the needle valve element (22), said bearing ring having formed thereon said pivot bearing (22).

3. Valve according to claim 1, wherein the plate-like rocker element (19) is formed with a depression facing said pivot bearing, and fitting thereover.

4. Valve according to claim 2, wherein the plate-like rocker element (19) is formed with a depression facing said pivot bearing and fitting thereover;

and wherein said groove (23) is elongated, and said pivot bearing is a knife edge fitting into the groove.

5. Valve according to claim 1, further including a spring disk (18) interposed between the closing spring (17) and the rocker element (19).

6. Valve according to claim 5, wherein the spring disk (18) has a centrally positioned pressure transfer projection;

and the plate-like rocker element (19) is formed with a matching, centrally positioned depression, receiving the pressure transfer projection and maintaining the centered relationship of said spring disk and said rocker element.

7. Valve according to claim 1, wherein the needle valve element (2) is formed with a blind bore (8) at its injection end;

an auxiliary needle (9) is located within the blind bore, and retained therein by a lost-motion retention element (13);

and said nozzle openings include a plurality of nozzle openings formed in the tubular housing at the injection end of the valve, staggered longitudinally, and sequentially exposed to fluid pressure as the stroke of the needle valve element (2) increases and the lost motion is overcome to carry along the auxiliary needle element (9).

8. Valve according to claim 4, further including a spring disk (18) interposed between the closing spring (17) and the rocker element (19);

wherein the spring disk (18) has a centrally positioned pressure transfer projection;

and the plate-like rocker element (19) is formed with a matching, centrally positioned depression, receiving the pressure transfer projection and maintaining the centered relationship of said spring disk and said rocker element.

* * * * *